US011542963B2

(12) United States Patent
Ueda

(10) Patent No.: US 11,542,963 B2
(45) Date of Patent: Jan. 3, 2023

(54) HYDRAULIC DRIVE DEVICE FOR TRAVELING WORK MACHINE

(71) Applicant: KOBELCO CONSTRUCTION MACHINERY CO., LTD., Hiroshima (JP)

(72) Inventor: Koji Ueda, Hiroshima (JP)

(73) Assignee: KOBELCO CONSTRUCTION MACHINERY CO., LTD., Hiroshima (JP)

( * ) Notice: Subject to any disclaimer, the term of this patent is extended or adjusted under 35 U.S.C. 154(b) by 0 days.

(21) Appl. No.: 17/276,244

(22) PCT Filed: Sep. 2, 2019

(86) PCT No.: PCT/JP2019/034476
§ 371 (c)(1),
(2) Date: Mar. 15, 2021

(87) PCT Pub. No.: WO2020/066483
PCT Pub. Date: Apr. 2, 2020

(65) Prior Publication Data

US 2022/0034335 A1 Feb. 3, 2022

(30) Foreign Application Priority Data

Sep. 28, 2018 (JP) ..... JP2018-184070

(51) Int. Cl.
*F15B 15/18* (2006.01)
*E02F 9/22* (2006.01)

(52) U.S. Cl.
CPC ..... *F15B 15/18* (2013.01); *E02F 9/2228* (2013.01); *E02F 9/2235* (2013.01);
(Continued)

(58) Field of Classification Search
CPC ..... E02F 9/2235; E02F 9/2242; E02F 9/2253; E02F 9/2228; E02F 9/2285; E02F 9/2282
See application file for complete search history.

(56) References Cited

U.S. PATENT DOCUMENTS 5,052,179 A * 10/1991 Fujii ..... E02F 9/2292 60/444
5,692,377 A * 12/1997 Moriya ..... E02F 9/2242 60/427

(Continued)

FOREIGN PATENT DOCUMENTS

CN 103649553 A 3/2014
JP 5-60236 A 3/1993

(Continued)

OTHER PUBLICATIONS

English Machine Translation of JPH06306892A Nov. 1994 to Niwada. (Year: 1994).*
Extended European Search Report dated Sep. 24, 2021 in European Patent Application No. 19865950.0, citing document AA therein, 10 pages.

(Continued)

*Primary Examiner* — Thomas E Lazo
(74) *Attorney, Agent, or Firm* — Oblon, McClelland, Maier & Neustadt, L.L.P.

(57) ABSTRACT

Provided is a hydraulic drive apparatus including a specific working actuator making a working arm perform a traveling assist motion upon the slip, first and second traveling motors, first and second hydraulic pumps, a traveling selector valve switchable to a neutral position and a straight traveling position, a communication throttle portion between a working fluid passage and a traveling fluid passage in the straight traveling position, and a switching control part switching the traveling selector valve to the neutral position when a single operation action is performed and to the (Continued)

straight traveling position when a specific combined operation action including a forward traveling operation and the specific working operation is performed. The switching control section adjusts the opening of the communication throttle section to decrease the flow rate therethrough with an increase in the difference between the first and second pump pressures.

6 Claims, 8 Drawing Sheets

(52) U.S. Cl.
CPC ..... *E02F 9/2242* (2013.01); *E02F 9/2253* (2013.01); *E02F 9/2282* (2013.01); *E02F 9/2285* (2013.01); *F15B 2211/57* (2013.01)

(56) References Cited

U.S. PATENT DOCUMENTS 6,148,548 A 11/2000 Tohji
6,430,922 B2 * 8/2002 Tohji ..... E02F 9/2296 60/421
6,708,490 B2 * 3/2004 Toji ..... E02F 9/2296 60/428
7,497,080 B2 * 3/2009 Ueda ..... E02F 9/225 60/429
7,841,175 B2 * 11/2010 Koo ..... F15B 11/16 60/486

FOREIGN PATENT DOCUMENTS

JP 6-306892 A 11/1994
JP 9-137474 A 5/1997
JP 11-50494 A 2/1999
JP 2000-17693 A 1/2000
JP 2010-156135 A 7/2010
JP 2014-148994 A 8/2014
WO WO 2016/043206 A1 3/2016

OTHER PUBLICATIONS

International Search Report dated Nov. 26, 2019 in PCT/JP2019/034476 filed Sep. 2, 2019, citing documents AA and AO-AQ therein, 1 page.
Combined Chinese Office Action and Search Report dated Aug. 22, 2022 in Chinese Patent Application No. 201980057303.8 (with unedited computer generated English translation), citing documents 15 through 17 therein, 15 pages.

* cited by examiner

HYDRAULIC DRIVE DEVICE FOR TRAVELING WORK MACHINE

TECHNICAL FIELD

The present invention relates to a hydraulic drive apparatus installed in a traveling type working machine such as a hydraulic excavator.

BACKGROUND ART

As a hydraulic drive apparatus installed in a traveling type working machine such as a hydraulic excavator, conventionally known is one described in Patent Literature 1.

The hydraulic drive apparatus includes: a left traveling motor and a right traveling motor that are supplied with hydraulic fluid to make a lower traveling body travel; a plurality of working actuators that are supplied with hydraulic fluid to be operated to actuate a working device, the plurality of working actuators including a boom cylinder, an arm cylinder and a bucket cylinder; a first hydraulic pump and a second hydraulic pump each configured to discharge hydraulic fluid; and a traveling control valve. The traveling control valve has a neutral position, an independent traveling position, and a straight traveling position. The traveling control valve is set to the neutral position when only a traveling operation is made, that is, when a single traveling operation is made, to form a fluid passage for directly supplying hydraulic fluid from the first hydraulic pump and the second hydraulic pump to the left traveling motor and the right traveling motor, respectively. The traveling control valve is switched to the straight traveling position when the traveling operation and a working operation for moving the working device are simultaneously made, that is, when combined operations are made, to form a traveling fluid passage for supplying hydraulic fluid from the first hydraulic pump to both the left traveling motor and the right traveling motor, and a working fluid passage for supplying hydraulic fluid from the second hydraulic pump to each of the working actuators independently of the traveling fluid passage. In the straight traveling position, furthermore, the traveling fluid passage and the working fluid passage are communicated with each other through a communication passage, thereby reducing a traveling deceleration shock at the time of switching to the straight traveling position.

The hydraulic drive apparatus further has a function of preventing pressure interference between the first and second hydraulic pumps by switching the traveling control valve from the straight traveling position to the independent traveling position when the difference between the discharge pressure of the first hydraulic pump and the discharge pressure of the second hydraulic pump is large.

The above-mentioned traveling type working machine involves a possibility that the traveling body slips to a traveling surface depending on a traveling condition to be thereby brought into an idling state, thus disabled from traveling. The idling traveling body could be assisted to travel by utilization of the driving force of the working device, for example, by sticking the tip of the bucket of the working device into the ground and moving the arm of the working device in the crowding direction; however, the idling of the traveling body remarkably lowers the driving load of the right and left traveling motors, which may cause the hydraulic fluid which is originally to be supplied to the working device to flow to the right and left traveling motor through the communication passage in the intermediate position to thereby disable the working device from moving.

Patent Literature 1 discloses to restrict or block the communication between the first and second hydraulic pumps when the difference between respective pump pressures of the first and second hydraulic pumps is equal to or greater than a certain value while the combined operations are performed; however, such a control hardly enables supply of hydraulic fluid to be performed suitably for the degree of the slip of the traveling body. Specifically, in the case where the difference between the pump pressure is relatively small, the restriction or block of the communication is not performed, which may permit even a small degree of slip to hinder the working device from being successfully moved, because of the large deviation of the supply of hydraulic fluid to the traveling motors. Conversely, the performance of restriction or block of the communication hinders or uniformly restrains hydraulic fluid discharged from the second hydraulic pump from being supplied to the traveling motors, which disables the traveling motor from being supplied with sufficient hydraulic fluid even when the degree of slip is lowered to allow the traveling body to travel.

CITATION LIST

Patent Literature

Patent Literature 1: Japanese Unexamined Patent Publication No. 2000-17693

SUMMARY OF INVENTION

An object of the present invention is to provide a hydraulic drive apparatus for hydraulically moving a traveling type working machine provided with a traveling body and a working arm, the hydraulic drive apparatus being capable of performing a suitable supply of hydraulic fluid upon the slip of the traveling body.

Provided is a hydraulic drive apparatus installed in a traveling type working machine, which includes a machine body and a working arm, the machine body including a first traveling body and a second traveling body that are arranged left and right and capable of performing respective traveling motions of traveling forward and backward on a traveling surface, the working arm being supported by the machine body and capable of performing a working motion including a traveling assist motion of moving the machine body forward while a tip of the working arm is stuck into the ground, to hydraulically cause the traveling motions of the first traveling body and the second traveling body and the working motion of the working device. The hydraulic drive apparatus includes: a plurality of working actuators that are supplied with hydraulic fluid to thereby actuate the working arm, the working actuators including a specific working actuator that makes the working arm perform the traveling assist motion; a first traveling motor that is supplied with hydraulic fluid to thereby actuate the first traveling body; a second traveling motor that is supplied with hydraulic fluid to thereby actuate the second traveling body; a first hydraulic pump and a second hydraulic pump that discharge hydraulic fluid to be supplied to a plurality of hydraulic actuators including the plurality of working actuators, the first traveling motor and the second traveling motor; a traveling selector valve selectively switchable to a neutral position and a straight traveling position as a position for forming a flow passage to lead hydraulic fluid discharged from the first hydraulic pump and the second hydraulic pump to the plurality of hydraulic actuators, the traveling selector valve forming, in the neutral position, a fluid passage that allows hydraulic fluid discharged from the first hydraulic pump to be supplied to the first traveling motor and allows hydraulic fluid discharged from the second hydraulic pump to be supplied to the second traveling motor and the -specific working actuator and forming, in the straight traveling position, a working fluid passage that allows hydraulic fluid discharged from the first hydraulic pump to be supplied to the specific working actuator while preventing hydraulic fluid discharged from the first hydraulic pump from being supplied to the first traveling motor and the second traveling motor, and a traveling fluid passage that allows hydraulic fluid discharged from the second hydraulic pump to be supplied to the first traveling motor and the second traveling motor; a communication throttle portion provided in a communication passage providing communication between the working fluid passage and the traveling fluid passage so as to allow hydraulic fluid to flow from the working fluid passage to the traveling fluid passage, the communication throttle portion having an opening degree variable to increase and decrease a flow rate of the hydraulic fluid in the communication passage; a first pump pressure detector that detects a first pump pressure which is a pressure of hydraulic fluid that the first hydraulic pump discharges; a second pump pressure detector that detects a second pump pressure which is a pressure of hydraulic fluid that the second hydraulic pump discharges; and a switching control part configured to switch the traveling selector valve to the neutral position when a single operation action of making only one of a traveling operation for making the first traveling body and the second traveling body travel and a specific working operation for moving the specific working actuator is performed and configured to switch the traveling selector valve to the straight traveling position when a specific combined operation action of simultaneously making a forward traveling operation for making the lower traveling body travel forward and the specific working operation is performed. The switching control part is configured to perform a communication control of adjusting the opening degree of the communication throttle part so as to reduce the flow rate of the hydraulic fluid in the communication passage with an increase in a pump pressure difference, which is a difference between the first pump pressure and the second pump pressure, in the case where the pump pressure difference is positive when the specific combined operation action is performed.

DESCRIPTION OF EMBODIMENTS

There will be described preferred embodiments of the invention with reference to the drawings.

Figure 1:
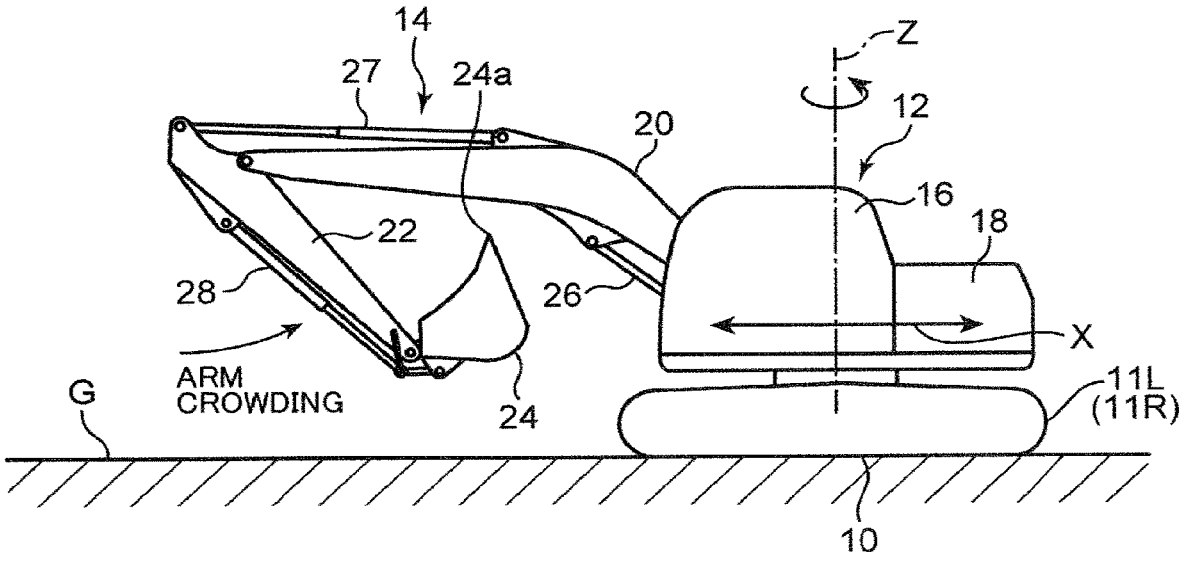
FIG. 1 is a side view of a hydraulic excavator which is a traveling working machine according to an embodiment of the present invention.

FIG. 1 shows a hydraulic excavator according to the embodiment. The present invention is not limited to the hydraulic excavator shown here but allowed to be widely applied to a working machine provided with a first traveling body, a second traveling body and a working arm and operated by a hydraulic pressure as a main power.

The hydraulic excavator includes a lower traveling body 10 capable of traveling on the ground G, an upper slewing body 12 mounted on the lower traveling body 10 so as to be slewable about a vertical axis Z, the upper slewing body 12 constituting a base in cooperation with the lower traveling body 10, and a working arm 14. In the front portion of the upper slewing body 12 longitudinally thereof, a cab 16 is provided as an operation room on the front side and the working arm 14 is mounted, while an engine room 18 is provided in the rear portion of the upper slewing body 12.

The lower traveling body 10 includes a not-graphically-shown traveling frame and a right crawler 11R and a left crawler 11L which are disposed on the right and left of the traveling frame, respectively. In FIG. 1, the right crawler 11R is located behind the left crawler 11L. The right and left crawlers 11R and 11L are driven forward or backward individually as described later specifically. In this embodiment, the right crawler 11 R and the left crawler 11L correspond to a first traveling body and a second traveling body according to the present invention, respectively.

The working arm 14 includes a boom 20, an arm 22, and a bucket 24. The boom 20 has a proximal end portion and a distal end portion on the opposite side thereto, the proximal end portion being supported on the front end of the upper slewing body 12 so as to be raisable and lowerable, that is, movable vertically and rotationally about a horizontal axis. The arm 22 has a proximal end and a distal end opposite thereto, the proximal end being connected to the distal end of the boom 20 so as to be movable rotationally about a horizontal axis. The bucket 24 is a distal attachment which is attached to the distal end portion of the arm 22 so as to be rotationally movable, being configured to mainly perform an excavation motion. The bucket 24 has a tip, which forms a cutting edge 24*a* stickablc into the ground.

The hydraulic excavator includes a plurality of hydraulic actuators. The plurality of hydraulic actuators include a plurality of working actuators, a not-graphically-shown slewing motor which is a hydraulic motor for slewing the upper slewing body 12, and hydraulic motors for traveling the lower traveling body 10, namely, a right traveling motor 25R and a left traveling motor 25L shown in FIG. 2.

The plurality of working actuators includes a boom cylinder 26 for raising and lowering the boom 20, an arm cylinder 27 for rotationally actuating the arm 22 relatively to the boom 20, and a bucket cylinder 28 for rotationally actuating the bucket 24 relatively to the arm 27.

The right traveling motor 25R is connected to the right crawler 11R to actuate the right crawler 11R. The left traveling motor 25L is connected to the left crawler 11L to actuate the left crawler 11L. In this embodiment, the right traveling motor 25R corresponds to a first traveling motor that actuates the right crawler 11R which is the first traveling body, while the left traveling motor 25L corresponds to a second traveling motor that actuates the left crawler 111, which is the second traveling body.

Figure 2:
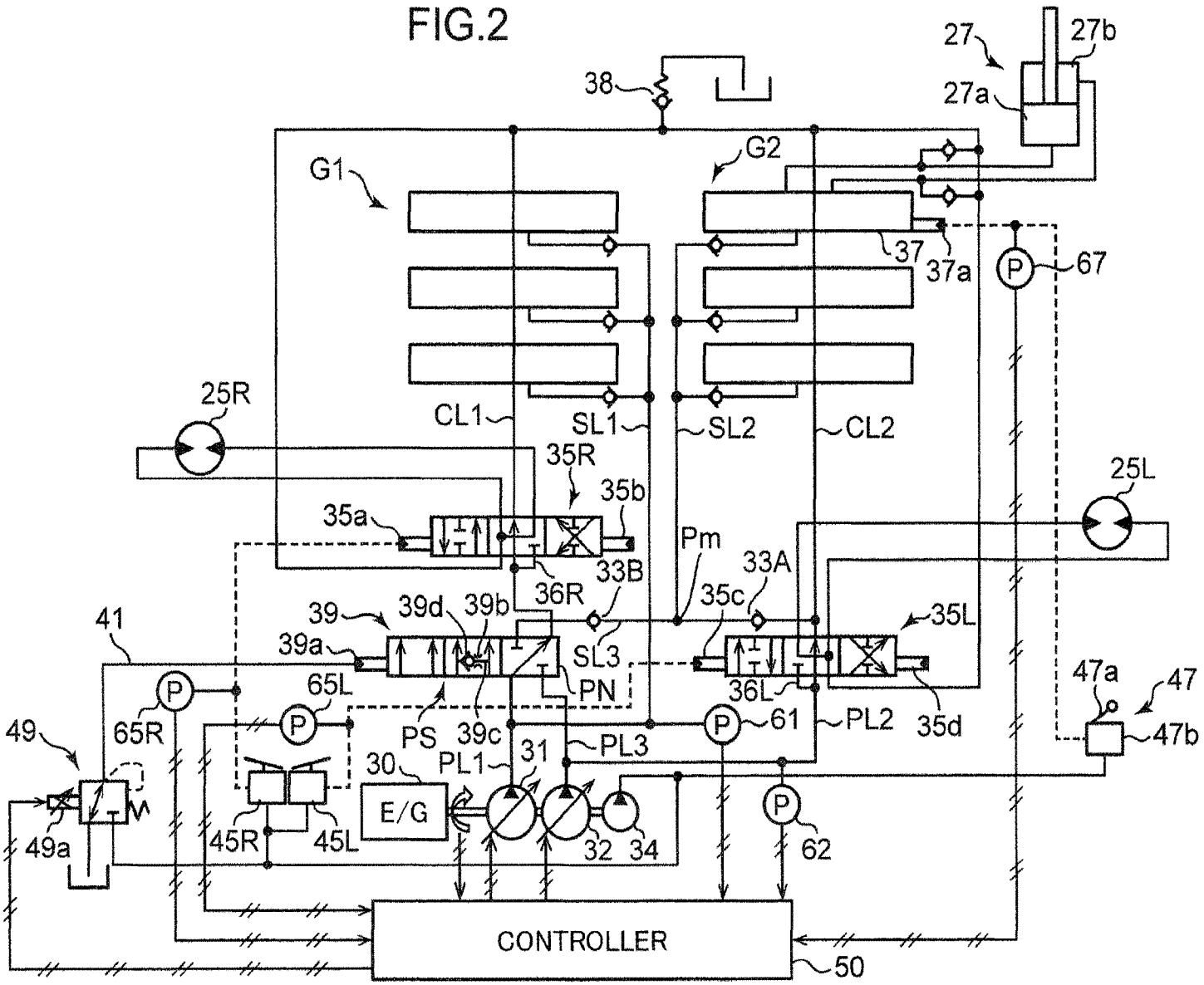
FIG. 2 is a hydraulic circuit diagram showing a hydraulic circuit installed in the hydraulic excavator and a controller connected thereto.

FIG. 2 shows a hydraulic circuit installed in the hydraulic excavator. The hydraulic circuit has a function of supplying hydraulic fluid to the plurality of hydraulic actuators including the right and left traveling motors 25R and 25L and the arm cylinder 27 and controlling the direction and flow rate of the supply. Specifically, the hydraulic circuit includes: a plurality of hydraulic pumps coupled to an output shaft of the engine 30, namely, a first main pump 31, a second main pump 32 and a pilot pump 34; a plurality of actuator control valves; and a plurality of actuator operation devices. The hydraulic circuit is electrically connected to a controller 50 for controlling the operation of the hydraulic circuit.

The right and left traveling motors 25R and 25L have respective output shafts that are rotated by supply of hydraulic fluid thereto, and the output shafts are connected to the right and left crawlers 11R and 11L to actuate the right crawler 11R and the left crawler 11L forward and backward, respectively. Each of the right and left traveling motors 25R and 25L, specifically, has a pair of ports, configured to have the output shaft rotated by supply of hydraulic fluid to one of the ports in the direction corresponding to the one port while discharging hydraulic fluid from the other port.

The arm cylinder 27, similarly to the boom cylinder 26 and the bucket cylinder 28 which are not shown in FIG. 2, has a bottom chamber 27*a* and a rod chamber 27*b* on the opposite side to the bottom chamber 27*a*. The arm cylinder 27 is expanded by supply of hydraulic fluid to the bottom chamber 27*a* to actuate the arm 22 in a crowding direction in which the arm 22 approaches the boom 20 located rearward thereof while discharging hydraulic fluid from the rod chamber 27*b*. The arm cylinder 27 is contracted, conversely, by supply of hydraulic fluid to the rod chamber 27*b* to actuate the arm 22 in a pushing direction in which the arm 22 goes away frontward from the boom 20 while discharging hydraulic fluid from the bottom chamber 27*a*.

Each of the pumps 31, 32, and 34 is driven by the engine 30, thereby discharging fluid in the tank. The first and second main pumps 31 and 32 discharge hydraulic fluid for directly moving the hydraulic actuator to be driven out of the plurality of hydraulic actuators, thus corresponding to the first hydraulic pump and the second hydraulic pump according to the present invention, respectively. The pilot pump 34 discharges pilot fluid for supplying pilot pressure to the plurality of actuator control valves. Each of the first and second main pumps 31 and 32 according to this embodiment is composed of a variable displacement hydraulic pump, having a capacity, namely, a pump capacity, operable by a pump capacity command that is input from the controller 50 to each of the first and second main pumps 31 and 32.

The plurality of actuator control valves are interposed between the first main pump 31 or the second main pump 32 and a plurality of hydraulic actuators corresponding to the plurality of actuator control valves, respectively, and operated to control the direction and the flow rate of hydraulic fluid supplied from the first main pump 31 or the second main pump 32 to the hydraulic actuators. Each of the plurality of actuator control valves is composed of a pilot operated hydraulic selector valve, which is opened by supply of the pilot pressure by a stroke corresponding to the magnitude of the pilot pressure to thereby allow hydraulic fluid to be supplied to the hydraulic actuator at a flow rate corresponding to the stroke. This enables the flow rate to be controlled through changing the pilot pressure.

The plurality of actuator control valves according to this embodiment belong to one of a first group G1 and a second group G2. The actuator control valve belonging to the first group G1 is supplied with hydraulic fluid discharged from the first main pump 31 when a single operation action is performed. The single operation action is an action of making only one operation of a traveling operation for traveling the lower traveling body 10 and a working operation for moving the working arm 14. The actuator control valve belonging to the second group G2 is supplied with hydraulic fluid discharged from the second main pump 32 when the single operation action is performed. Specifically, the first main pump 31 has a discharge port, to which a first center bypass line CL1 communicated with the tank via a back-pressure valve 38 is connected, and the actuator control valves belonging to the first group G1 are arranged in tandem along the first center bypass line CL1. Similarly, the second main pump 32 has a discharge port, to which a second center bypass line CL2 communicated with the tank via the back-pressure valve 38 is connected, and the actuator control valves belonging to the second group G2 are arranged in tandem along the second center bypass line CL2.

To the discharge port of the first main pump 31 is connected a first supply line SL1 in parallel with the first center bypass line CL1. The first supply line SL1 is further branched for the plurality of actuator control valves belonging to the first group G1, respectively, and connected to the actuator control valves so as to distribute hydraulic fluid discharged from the first main pump 31 to the actuator control valves belonging to the first group G1.

Similarly, to the discharge port of the second main pump 32 is connected a second supply line SL2 in parallel with the second center bypass line CL2. The second supply line SL2 is further branched for the plurality of actuator control valves belonging to the second group G2, respectively, and connected to the actuator control valves belonging to the second group G2 to distribute hydraulic fluid discharged from the second main pump 32 to the actuator control valves belonging to the second group G2.

The plurality of actuator control valves include a right traveling control valve 35R and a left traveling control valve 35L which are connected to the right and left traveling motors 25R and 25L, respectively, and a plurality of working actuator control valves connected to the plurality of working actuators, respectively. The plurality of working actuator control valves include an arm control valve 37 connected to the arm cylinder 27 which is a specific working actuator. The right traveling control valve 35R belongs to the first group G1, while the left traveling control valve 35L and the arm control valve 37 belong to the second group G2.

The right traveling control valve 35R and the left traveling control valve 35L lead hydraulic fluid for driving the right and left traveling motors 25R and 25L, respectively, to selective one of the pair of ports of each of the right and left traveling motors 25R and 25L, and control the right traveling flow rate and the left traveling flow rate, which are respective flow rates of the hydraulic fluid supplied to the right and left traveling motors 25R and 25L.

Each of the right and left traveling control valves 35R and 35L is a three-position pilot selector valve, having a pair of forward and backward traveling pilot ports. Specifically, the right traveling control valve 35R has a forward traveling pilot port 35*a* and a backward traveling pilot port 35*b* opposite thereto, and the left traveling control valve 35L has a forward traveling pilot port 35*c* and a backward traveling pilot port 35*d* opposite thereto.

The right traveling control valve 35R is kept in a neutral position when the pilot pressure supplied to each of the forward traveling and backward traveling pilot ports 35*a* and 35*b* is zero or minute, blocking the right traveling motor 25R from the hydraulic source thereof (e.g., the first main pump 31) while opening the first center bypass line CL1, in the neutral position. By supply of a pilot pressure above a fixed level to the forward traveling pilot port 35*a* or the backward traveling pilot port 35*b*, the right traveling control valve 35R is shifted from the neutral position in the direction corresponding to the pilot port to which the pilot pressure is supplied and by a stroke corresponding to the magnitude of the pilot pressure to provide communication between the first supply line SL1 and the port corresponding to the pilot port out of the pair of ports of the right traveling motor 25R with an opening area corresponding to the stroke, thereby causing the right traveling motor 25R to operate in a direction corresponding to the stroke (for example, the direction is a forward traveling direction when a pilot pressure is input to the forward traveling pilot port 35*a*) at a speed corresponding to the stroke.

The left traveling control valve 35L is kept in a neutral position when the pilot pressure supplied to each of the forward traveling and backward traveling pilot ports 35*a* and 35*b* is zero or minute, blocking the left traveling motor 25L from the hydraulic source thereof (e.g., the second main pump 32) while opening the second center bypass line CL2. By supply of a pilot pressure above a fixed level to the forward traveling pilot port 35*c* or the backward traveling pilot port 35*d*, the left traveling control valve 35L is shifted from the neutral position in the direction corresponding to the pilot port to which the pilot pressure is input and by a stroke corresponding to the magnitude of the pilot pressure to provide communication between the second supply line SL2 and the port corresponding to the pilot port out of the pair of ports of the left traveling motor 25L with an opening area corresponding to the stroke, thereby causing the left traveling motor 25L to operate in the direction corresponding to the stroke (for example, the direction is a forward direction when a pilot pressure is input to the forward traveling pilot port 35*c*) at a speed corresponding to the stroke.

The right traveling control valve 35R and the left traveling control valve 35L are disposed in the respective most upstream positions in the first and second center bypass lines CL1 and CL2. The right traveling control valve 35R and the left traveling control valve 35L are supplied with hydraulic fluid through respective dedicated supply passages 36L and 36R provided independently from the first and second supply lines SL1 and SL2 in the immediately upstream side of the right traveling control valve 35R and the left traveling control valve 35L, respectively. The first center bypass line CL1, thus, is branched for the other actuator control valves than the right traveling control valve 35R out of the plurality of actuator control valves belonging to the first group G1 to be connected to the other actuator control valves, respectively. On the other hand, the second supply line SL2 is branched off from a portion downstream of the left traveling control valve 35L in the second center bypass line CL2 to be connected to the plurality of actuator control valves located downstream of the left traveling control valve 35L (including the arm control valve 37).

The arm control valve 37 is a valve that leads hydraulic fluid discharged from the second main pump 32 to the arm cylinder 27 as main hydraulic fluid for driving the arm cylinder 27 to expand and contract it, being interposed between the second main pump 32 and the arm cylinder 27. The arm control valve 37 is a three-positions pilot selector valve, having an arm crowding pilot port 37*a* and a not-graphically-shown arm pushing pilot port on the opposite side thereto.

The arm control valve 37 is kept in a neutral position when the pilot pressure supplied to each of the arm crowding pilot port 37*a* and the arm pushing pilot port is zero or minute, blocking the communication between the second main pump 32 and the arm cylinder 27 while opening the second center bypass line CL2, in the neutral position. On the other hand, by supply of a pressure to the arm crowding pilot port 37*a*, the arm control valve 37 is shifted from the neutral position to the arm crowding position by a stroke corresponding to the magnitude of the pilot pressure, providing communication between the second supply line SL2 and the bottom chamber 27*a* to allow hydraulic fluid to be supplied to the bottom chamber 27*a* of the arm cylinder 27 from the second main pump 32 at a flow rate corresponding to the stroke, in the arm crowding position. By supply of a pilot pressure to the arm pushing pilot port, conversely, the arm control valve 37 interconnects the second supply line SL2 and the rod chamber 27*b* to allow hydraulic fluid to be supplied from the second main pump 32 to the rod chamber 27*b* of the arm cylinder 27.

The plurality of actuator operation devices are connected to the plurality of actuator control valves, respectively, each allowing an operation for moving the hydraulic actuator connected to the actuator control valve to be applied thereto and inputting a pilot pressure corresponding to the operation to the pilot port of the actuator control valve. Specifically, the plurality of actuator operation devices are provided between the pilot pump 34 and the plurality of actuator control valves, respectively, and configured to regulate the pilot primary pressure output from the pilot pump 34 to a degree corresponding to the operation to generate a pilot secondary pressure and to input the pilot secondary pressure to the pilot port of the actuator control valve as the pilot pressure of the actuator control valve.

The plurality of actuator operation devices includes a right traveling operation device 45R, a left traveling operation device 45L and an arm operation device 47 which are shown in FIG. 2.

The right traveling operation device 45R and the left traveling operation device 45L are traveling operation devices for receiving respective traveling operations for moving the right traveling motor 25R and the left traveling motor 25L, respectively. Each of the right and left traveling operation devices 45R and 45L, specifically, includes a pedal to which a depressing operation is applied as the traveling operation, and a traveling pilot valve that generates a traveling pilot pressure corresponding to the depressing operation applied to the pedal and inputs the traveling pilot pressure to the pilot port of each of the right traveling control valve 35R and the left traveling control valve 35L. For example, in response to a forward depressing operation applied to the pedal of the right traveling operation device 45R, the traveling pilot valve of the right traveling operation device 45R inputs such a forward traveling pilot pressure as to rotate the right traveling motor 25R in the forward direction at a speed corresponding to the magnitude of the depressing operation to the forward traveling pilot port 35*a* of the right traveling control valve 35R. In FIG. 2, for convenience sake, only the pilot line interconnecting the forward traveling pilot port 35*a* out of the forward and backward traveling pilot ports 35*a* and 35*b* of the right traveling control valve 35R and the right traveling operation device 45R is shown; similarly, only the pilot line interconnecting the forward traveling pilot port 35*c* out of the forward and backward traveling pilot ports 35*c* and 35*d* of the left traveling control valve 35L and the left traveling operation device 45L is shown.

The traveling operation according to the present invention is not limited to the above-described depression operation. The traveling operation may be a rotational operation to be applied to a traveling operation lever.

The arm operation device 47 receives an arm crowding operation and an arm pushing operation for expanding and contracting the arm cylinder 27 (i.e. actuating the arm 22 in the arm crowding direction and the arm pushing direction), respectively, and inputs a pilot pressure corresponding thereto to the arm control valve 37. The arm operation device 47, specifically, includes an arm operation lever 47*a* to which the arm crowding operation and the arm pushing operation are applied, and an arm pilot valve 47*b* which generates a pilot pressure corresponding to the arm crowding operation or the arm pushing operation applied to the arm operation lever 47*a* and inputs the pilot pressure to the arm control valve 37. For example, in response to the arm crowding operation applied to the arm operation lever 47*a*, the arm pilot valve 47*b* inputs such an arm crowding pilot pressure as to expand the arm cylinder 27 at a speed corresponding to the magnitude of the arm crowding operation to the arm crowding pilot port 37*a* of the arm control valve 37.

The hydraulic circuit shown in FIG. 2 further includes a traveling selector valve 39 and a stroke operation valve 49 for operating the traveling selector valve 39, as means for switching a flow passage for leading hydraulic fluid discharged from the first and second main pumps 31 and 32 to each of the plurality of hydraulic actuators.

The traveling selector valve 39 is composed of a pilot operated selector valve having a single pilot port 39a, being switchable between a neutral position PN and a straight traveling position PS shown in FIG. 2 by a pilot pressure input to the pilot port 39*a*.

The traveling selector valve 39 according to this embodiment is provided in the first center bypass line CL1, including a first input port, a second input port, a first output port, and a second output port. The first input port is connected to the discharge port of the first main pump 31 through a first pump line PL1 which is an upstream portion of the first center bypass line CL1, and the second input port is connected to the discharge port of the second main pump 32 through a third pump line PL3 branched off from a second pump line PL2 which is an upstream portion of the second center bypass line CL2 (a portion upstream of the left traveling control valve 35L). The first output port is connected to a third supply line SL3 from the first output port to a junction point Pm that is set in the second supply line SL2, and the second output port is connected to a downstream portion of the first center bypass line CL1, i.e., a portion downstream of the first pump line PL1. Besides, a portion of the second supply line SL2 upstream of the junction point Pm and the third supply line SL3 are provided with respective check valves 33A and 33B.

The traveling selector valve 39 is held in the neutral position PN with no input of any pilot pressure to the pilot port 39*a*. In the neutral position PN, the traveling selector valve 39 opens the first center bypass line CL1 to allow hydraulic fluid discharged from the first main pump 31 to be leaded to the hydraulic actuators belonging to the first group G1 including the right traveling motor 25R out of the plurality of hydraulic actuators, while preventing hydraulic fluid discharged from the second main pump 32 from being leaded to the hydraulic actuators belonging to the first group G1. In summary, the traveling selector valve 39 forms a fluid passage that allows the hydraulic fluid discharged from the first main pump 31 to be supplied only to the hydraulic actuators belonging to the first group G1 and allows the hydraulic fluid discharged from the second main pump 31 to be supplied only to the hydraulic actuators belonging to the second group G2.

In the neutral position PN, specifically, the traveling selector valve 39 according to this embodiment provides communication between the first input port and the second output port while closing the second input port and the first output port. The right traveling motor 25R corresponding to the first traveling motor in this embodiment, thus, is blocked from the second main pump 32 and connected only to the first main pump 31 through the traveling selector valve 39 in the neutral position PN.

The first supply line SL1 is branched off from the first pump line PL1 which is a portion upstream of the traveling selector valve 39 in the first center bypass line CL1. This causes, when the traveling selector valve 39 is switched to the neutral position PN, hydraulic fluid to be leaded to the right traveling control valve 35R via the traveling selector valve 39, while causing hydraulic fluid discharged from the first main pump 31 to bypass the traveling selector valve 39, regardless of the position of the traveling selector valve 39, to be leaded directly to the actuator control valve downstream of the right traveling control valve 35R.

By input of a pilot pressure above a fixed level is input to the pilot port 39*a*, the traveling selector valve 39 is shifted from the neutral position PN to the straight traveling position PS by a stroke ST corresponding to the magnitude of the pilot pressure. In the straight traveling position PS, the traveling selector valve 39 forms a working fluid passage that prevents hydraulic fluid discharged from the first main pump 31 from being supplied to the right traveling motor 25R and leads the hydraulic fluid to the hydraulic actuators belonging to the second group G2 including the arm cylinder 27, and a traveling fluid passage that allows hydraulic fluid discharged from the second main pump 32 to be supplied to the hydraulic actuator belonging to the first group GI including the right traveling motor 25R. The traveling selector valve 39 according to this embodiment, specifically, provides communication between the first input port and the first output port, in the straight traveling position PS, to thereby connect the first main pump 31 to the third supply line SL3 while blocking the first center bypass line CL1, and provides communication between the second input port and the second output port to thereby connect the second main pump 32 to the downstream-side portion of the first center bypass line CL1.

The traveling selector valve 39, furthermore, incorporates a communication passage 39*c* and a communication throttle portion 39*b*. The communication passage 39*c* is a fluid passage formed so as to provide communication between the traveling fluid passage and the working fluid passage in the straight traveling position PS, and the communication throttle portion 39*b* is a portion provided in the communication passage 39*c* and having an opening degree that is so variable as to increase or decrease the flow rate of hydraulic fluid in the communication passage 39*c*. In other words, the communication throttle portion 39*b* is a portion that makes variable the opening area of the communication passage 39*c*, namely, a communication opening area. The communication passage 39*c* according to this embodiment is provided with a check valve 39*d* in addition to the communication throttle portion 39*b*, the check valve 39*d* restricting the flow direction of hydraulic fluid in the communication passage 39*c* to a direction from the working fluid passage toward the traveling fluid passage.

Figure 3:
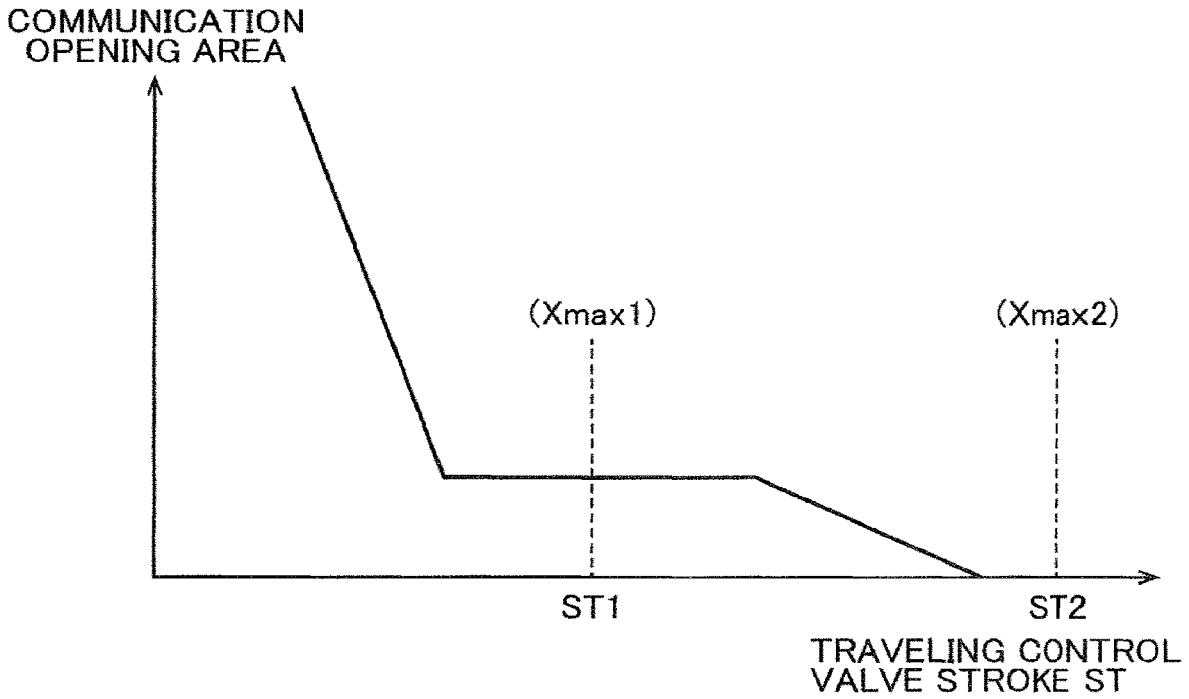
FIG. 3 is a graph showing the characteristics of a communication opening area to a stroke from a neutral position of a traveling selector valve included in the hydraulic circuit.

The traveling selector valve 39, as shown in FIG. 3, has a characteristic that the opening degree of the communication throttle portion 39*b* is decreased to reduce the communication opening area with an increase in the stroke ST from the neutral position PN. In short, the opening degree of the communication throttle portion 39*b* has a characteristic of decreasing with an increase in the stroke ST. This enables the communication opening area to be adjusted to control the flow rate of hydraulic fluid in the communication passage 39*c*, through the operation of the stroke ST. Besides, the opening degree characteristic of the communication throttle portion 39*b* provides an effect of reducing a torque shock caused by a sudden decrease in the flow rate of hydraulic fluid supplied to the right and left traveling motors 25R and 25L accompanying the shift from the neutral position PN to the straight traveling position PS.

The stroke operation valve 49 constitutes a stroke operation part that changes the magnitude of the pilot pressure in response to a stroke command X input to the stroke operation valve 49 from the controller 50 to thereby change the stroke ST of the traveling selector valve 39. The stroke operation valve 49, specifically, is composed of a solenoid valve having a solenoid 49*a* to which an excitation current corresponding to the stroke command X is input, being provided in a pilot line 41 that interconnects the pilot pump 34 and the pilot port 39*a* of the traveling selector valve 39. The stroke operation valve 49 generates a secondary pressure corresponding to the stroke command to input the secondary pressure to the pilot port 39*a* of the traveling selector valve 39 as a pilot pressure of the traveling selector valve 39.

The hydraulic drive according to the embodiment further includes a plurality of pressure sensors. The plurality of pressure sensors include a first pump pressure sensor 61, a second pump pressure sensor 62, a right traveling pilot pressure sensor 65R, a left traveling pilot pressure sensor 65L, and an arm crowding pilot pressure sensor 67, each of which inputs an electrical signal corresponding to the detected pressure to the controller 50 as a pressure detection signal. The first pump pressure sensor 61 is configured to detect a first pump pressure P1 which is the pressure of hydraulic fluid discharged from the first main pump 31, being connected to the first pump line PL1. The second pump pressure sensor 62 is configured to detect a second pump pressure P2 which is the pressure of hydraulic fluid discharged from the second main pump 32, being connected to the second pump line PL2. The right and left traveling pilot pressure sensors 65R and 65L detect the right traveling pilot pressure and left traveling pilot pressure input to the right and left traveling control valves 35R and 35L, respectively, that is, the forward traveling pilot pressure in this embodiment, and the arm crowding pilot pressure sensor 67 is configured to detect the arm crowding pilot pressure Par input to the arm control valve 37.

Figure 4:
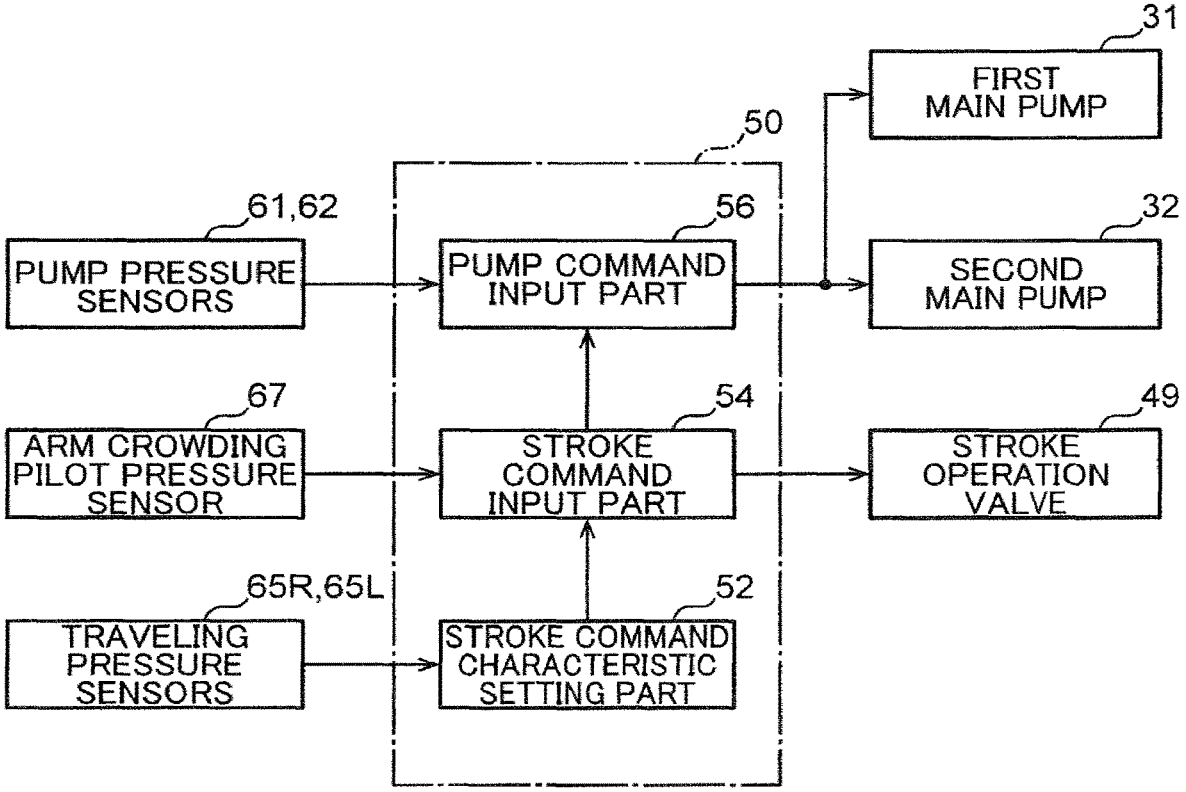
FIG. 4 is a block diagram showing a functional configuration of the controller.

The controller 50, based on the pressure detection signal input from the plurality of sensors, respectively, controls the stroke ST (from the neutral position PN) of the traveling selector valve 39 and respective pump capacities of the first and second main pumps 31 and 32. The controller 50, specifically, includes a stroke command characteristic setting part .52, a stroke command input part 54 and a pump command input part 56, as shown in FIG. 4.

The stroke command characteristic setting part 52 calculates a pump pressure difference ΔP (=P1−P2), which is a difference between the first pump pressure P1 and the second pump pressure P2, and sets a stroke command characteristic corresponding to the pump pressure difference ΔP if the pump pressure difference ΔP is zero or more, that is, if the first pump pressure P1 is equal to or more than the second pump pressure P2. The stroke command characteristic is a characteristic of the stroke command X to the arm crowding pilot pressure Par detected by the arm crowding pilot pressure sensor 67, that is, the stroke command X to be input to the stroke operation valve 49.

To switch the position of the traveling selector valve 39 based on the traveling operation state and the arm operation state, the stroke command input part 54 inputs the stroke command X to the stroke operation valve 49. The traveling operation state and the arm operation state is allowed to be grasped by the pressure detection signals of the traveling pilot pressure sensors 65R and 65L and the arm crowding pilot pressure sensor 67, respectively. Furthermore, as a feature of the apparatus, if the pump pressure difference ΔP is equal to or greater than zero, the stroke command input part 54 generates a stroke command X corresponding to the arm crowding pilot pressure Par based on the stroke command characteristic set by the stroke command characteristic setting part 52, and inputs the stroke command X to the stroke operation valve 49 to thereby execute a control of the stroke ST of the traveling selector valve 39, i.e., a control of the communication opening area that is changed by opening and closing the communication throttle portion 39*b*, through the stroke operation valve 49.

The stroke command characteristic setting part 52 and the stroke command input part 54, thus, form a stroke control part that controls the stroke ST.

The pump command input part 56 serves as a capacity control part that controls respective pump capacities of the first and second main pumps 31 and 32.

The pump command input part 56, specifically, calculates a flow rate ratio Rq with respect to the first main pump 31, the flow rate ratio Rq corresponding to the stroke command X, and inputs a pump capacity command to the first and second main pumps 31 and 32 to operate the pump capacities of the first and second main pumps 31 and 32 so as to provide the flow rate ratio Rq. The flow rate ratio Rq is the ratio of a first pump flow rate Q1 to the sum of the first pump flow rate Q1 and a second pump flow rate Q2 (Rq=Q1/(Q1+Q2)), wherein the first pump flow rate Q1 and the second pump flow rate Q2 are respective flow rates of hydraulic fluids discharged from the first main pump 31 and the second main pump 32.

Next will be described a specific arithmetic control operation performed by the controller 50 with reference to the flowchart of FIG. 5 and the graphs of FIGS. 6 to 8.

At the time when the single operation action of making only one of the left-right forward traveling operation and the arm crowding operation is performed (including the time when only the backward traveling operation is made), the stroke command input part 54 of the controller 50 sets the stroke ST of the traveling selector valve 39 to zero to hold the traveling selector valve 39 at the neutral position (steps S1 to S3). Specifically, when no forward traveling operation (depression operation in this embodiment) is applied to either of the right and left traveling operation devices 45R and 45L (NO in step S1), or when a forward traveling operation above a fixed level is applied to the right and left traveling operation devices 45R and 45L whereas no arm crowding operation is applied to the arm operation device 47

(YES in step S1 and NO in step S2), the stroke command input part 54 keeps the stroke command X to be input to the stroke operation valve 49 zero (step S3), substantially stopping the input of the stroke command X.

The traveling selector valve 39 is thereby held in the neutral position PN, forming a fluid passage for blocking the right traveling control valve 35 from the second main pump 32 but connecting the right traveling control valve 35 to the first main pump 31. This allows the hydraulic fluid discharged from the first main pump 31 to be leaded to the right traveling control valve 35R through the traveling selector valve 39, and allows the hydraulic fluid discharged from the second main pump 32 to be blocked from the right traveling control valve 35R but to be leaded to the left traveling control valve 35L and the arm control valve 37.

On the other hand, when a specific combined operation action of simultaneously applying forward traveling operations to the right and left traveling operation devices 45R and 45L and applying an arm crowding operation to the arm operation device 37 (YES in each of Steps Si and S2), the calculation of the pump pressure difference ΔP (=P1−P2) is performed, and when the calculated pump pressure difference ΔP is equal to or higher than zero (YES in Step S4), that is, when the first pump pressure P1 is equal to or higher than the second pump pressure P2 (P1≥P2), in other words, when the workload is equal to or greater than the traveling load, the communication control is performed (Step S5 and Step S6). The communication control is a stroke control based on the stroke command characteristic set by the stroke command characteristic setting part 52, i.e., the control of the communication opening area which is the opening area of the communication passage 39*c* in the straight traveling position PS of the traveling selector valve 39.

The stroke command characteristic setting part 52, specifically, based on the pump pressure difference ΔP, sets such a stroke command characteristic that the stroke command X is increased with an increase in the pump pressure difference ΔP (step S5). As an index for the setting, the stroke command characteristic setting part 54 according to this embodiment stores a pregiven characteristic of the stroke command maximum value Xmax to the pump pressure difference ΔP as shown in FIG. 6, and determines the stroke command maximum value Xmax based on the characteristic. This characteristic is a characteristic in which the stroke command maximum value Xmax is increased with an increase in the pump pressure difference AP. Based on the stroke command maximum value Xmax, the stroke command characteristic setting part 54 sets the stroke command characteristic as shown in FIG. 7, that is, the characteristics of the stroke command X to the arm crowding pilot pressure Par.

Figure 7:
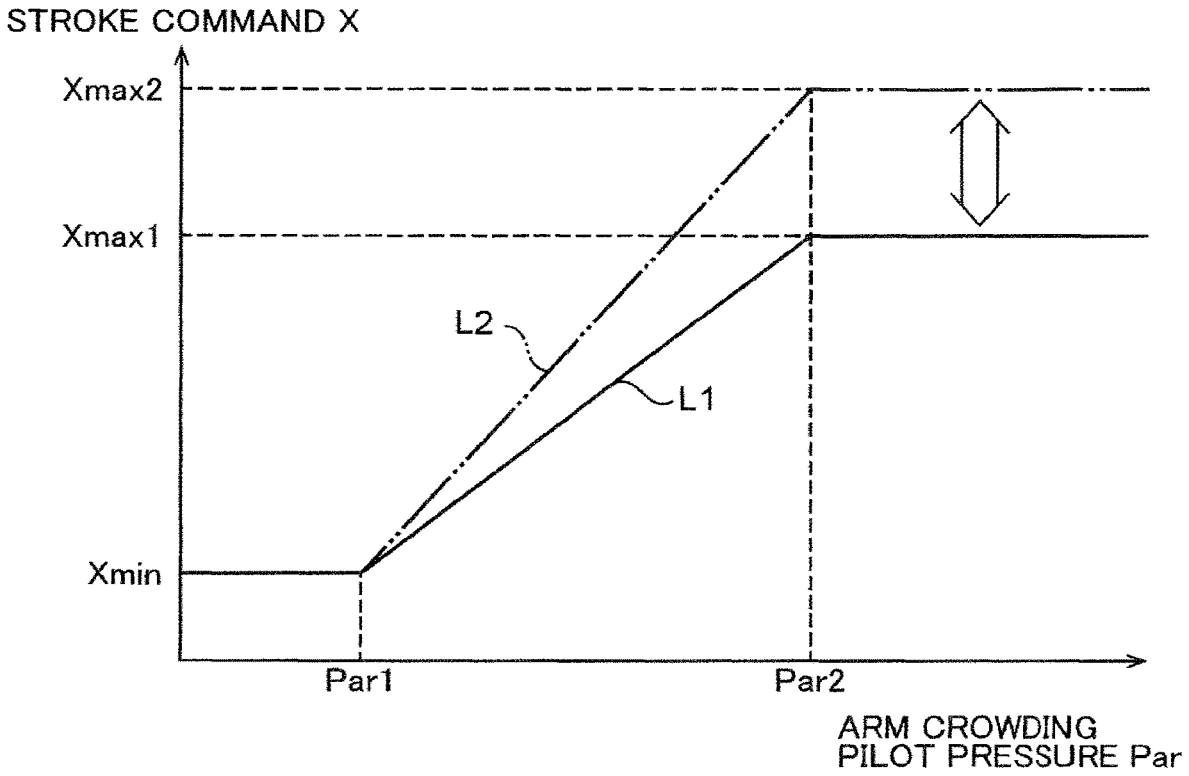
FIG. 7 is a graph showing the characteristics of a stroke command generated by a stroke command input part of the controller to an arm crowding operation pilot pressure.

The stroke command characteristic shown in FIG. 7 is such a characteristic that the larger the stroke command maximum value Xmax, the larger the stroke command X corresponding to the same arm crowding pilot pressure Par is. Specifically, the stroke command X is maintained at a common minimum value Xmin in a minute operation region in which the stroke arm crowding pilot pressure Par is equal to or less than a preset first pressure value Par1 (the range in which the arm crowding operation is considered to be substantially zero); the stroke command X is increased with an increase in the arm crowding pilot pressure Par to the maximum value Xmax in an intermediate region in which the arm crowding pilot pressure Par is equal to or greater than the first pressure value Parl and less than a preset second pressure value Par2 (>Par1); the stroke command X is maintained at the maximum value Xmax in a full operation region in which the arm crowding pilot pressure Par is equal to or greater than the second pressure value Par2.

Figure 6:
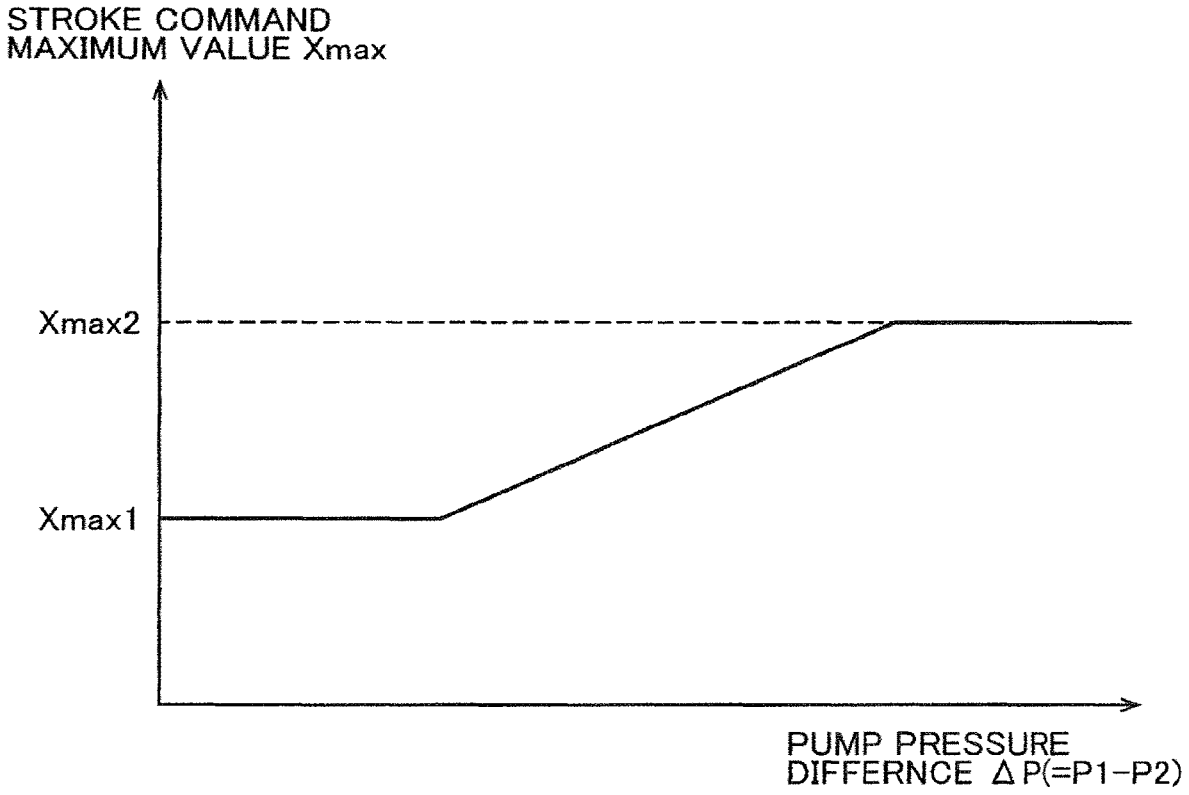
FIG. 6 is a graph showing the relationship between the pump pressure difference in the hydraulic circuit and the stroke command maximum value set by a stroke command characteristic setting part of the controller.

For example, the stroke command characteristic when the stroke command maximum value Xmax is determined to be the first maximum value Xmaxl shown in FIG. 6 is set to the characteristic indicated by the line L1 in FIG. 7, while the stroke command characteristic when the stroke command maximum value Xmax is determined to be the second maximum value Xmax2 (>Xmax1) larger than the first maximum value Xmax1 is set to the characteristic indicated by the line L2 in FIG. 7, that is, the characteristic in which the gradient in the intermediate region is larger than the gradient of the line L1. As shown in FIG. 3, the stroke ST1 corresponding to the first maximum value Xmax1 is a stroke that causes a slight communication opening area to remain in the communication throttle portion 39*b*, while the second stroke ST2 corresponding to the second maximum value Xmax2 is a stroke that makes the communication opening area zero, that is, a stroke that causes the communication throttle portion 39*b* to be fully closed to block the communication passage 39*c*.

Based on the thus set stroke command characteristic, the stroke command input part 54 generates a stroke command X corresponding to the arm crowding pilot pressure Par, and inputs the stroke command X to the stroke operation valve 49 (step S6). This causes the traveling selector valve 39 to be switched to the straight traveling position PS and allows the communication control to be executed to increase the stroke ST from the neutral position PN of the traveling selector valve 39 with increase in the pump pressure difference ΔP to reduce the communication opening area as shown in FIG. 3. The communication opening area is the opening area of the communication passage 39*c* formed in the straight traveling position PS.

The communication control makes it possible to supply hydraulic fluid to the right and left traveling motors 25R and 25L and the arm cylinder 27 at a flow rate distribution appropriate to the degree of a slip of at least one of the right and left crawlers 11R and 11L to the traveling surface.

Specifically, when the degree of the slip is so large that the traveling by the right and left crawlers 11R and 11L is hardly performable, it is necessary to perform a traveling assist motion of moving the arm 22 in the crowding direction with the cutting edge 24*a* of the bucket 24 stuck into the ground to move the machine body forward, but the occurrence of slip has remarkably reduced the load of at least one of the right and left traveling motors 25R and 25L (traveling load). This may cause, if the communication passage 39*c* is greatly opened, not only the hydraulic fluid discharged from the second main pump 32 but also the hydraulic fluid discharged from the first main pump 31 to flow to the traveling fluid passage to thereby render impossible the arm crowding motion for the traveling assist motion. The communication control, however, makes it possible to cause the first main pump 31 to supply sufficient hydraulic fluid to the arm cylinder 27 for performing the traveling assist motion by, for example, setting the stroke command maximum value Xmax to the second maximum value Xmax2 to give a large stroke ST to the traveling selector valve 39 to thereby significantly limit the opening area of the communication passage 39*c* (for example, the communication passage 39*c* is blocked as shown in FIG. 3 in the second maximum value Xmax2) when the degree of the slip is so large that the second pump pressure P2 is significantly low, that is, when the pump pressure difference ΔP (P1−P2) is large.

In contrast, in a state where the pump pressure difference AP has been small, that is, in a state where the degree of the slip has been lowered to raise the traveling load to some extent to thereby allow the traveling to be performed by the right and left crawlers 11R and 11L, for example, setting the stroke command maximum value Xmax to the first maximum value Xmaxl to reduce the stroke ST of the traveling selector valve 39 to widen the communication opening area to allow a part of hydraulic fluid discharged from the first main pump 31 to be supplied to the right traveling motor 25R makes it possible to decrease the rate of the traveling assist motion to increase the rate of the normal traveling motion.

Accompanying this communication control, the pump command input part 56 of the controller 50 further executes the pump capacity control corresponding to the communication control. The pump command input part 56, specifically, calculates the flow rate ratio Rq corresponding to the stroke command X and inputs the pump capacity command for providing the flow rate ratio Rq to the first and second main pumps 31 and 32 (step S7).

Figure 8:
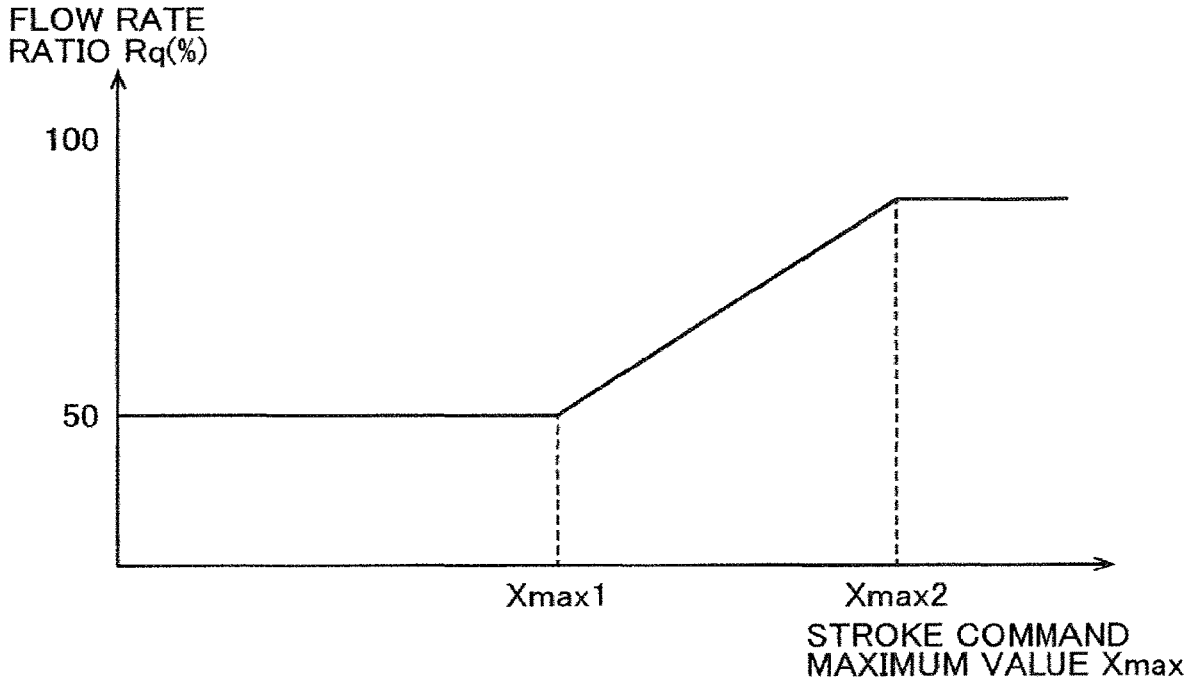
FIG. 8 is a graph showing the relationship between the stroke command maximum value and a pump capacity command generated by a pump command input part of the controller.

The pump command input part 56 according to this embodiment, based on the characteristic as shown in FIG. 8, i.e. the characteristic of the flow rate ratio Rq to the stroke command maximum value Xmax set in advance, calculates the larger flow rate ratio Rq, that is, the ratio of the first pump flow rate Q1 to the sum of the first and second pump flow rates Q1, Q2 (=Q1/(Q1+Q2), as the stroke command maximum value Xmax is larger, and controls respective capacities of the first and second main pumps 31 and 32 so as to provide the thus calculated flow rate ratio Rq. Such a pump capacity control, making the capacity of the first main pump 31 for supplying hydraulic fluid to the arm cylinder 27 larger relatively to the capacity of the second main pump 32 as the stroke command X is larger, that is, as the work load (more precisely, the load for the arm crowding motion) is larger relatively to the traveling load, enables highly efficient operation that corresponds to the communication control to be made.

When the pump pressure difference ΔP is negative, that is, when the first pump pressure P1 is smaller than the second pump pressure P2 (P1<P2) and the work load is smaller than the traveling load (NO in step S4), the stroke command input part 54 inputs the maximum stroke command X to the stroke operation valve 49 to bring the traveling selector valve 39 into a full stroke (step S8). The control at this time, however, is not limited thereto. The stroke ST of the traveling selector valve 39 at this time may be set to a stroke smaller than the maximum stroke.

Figure 5:
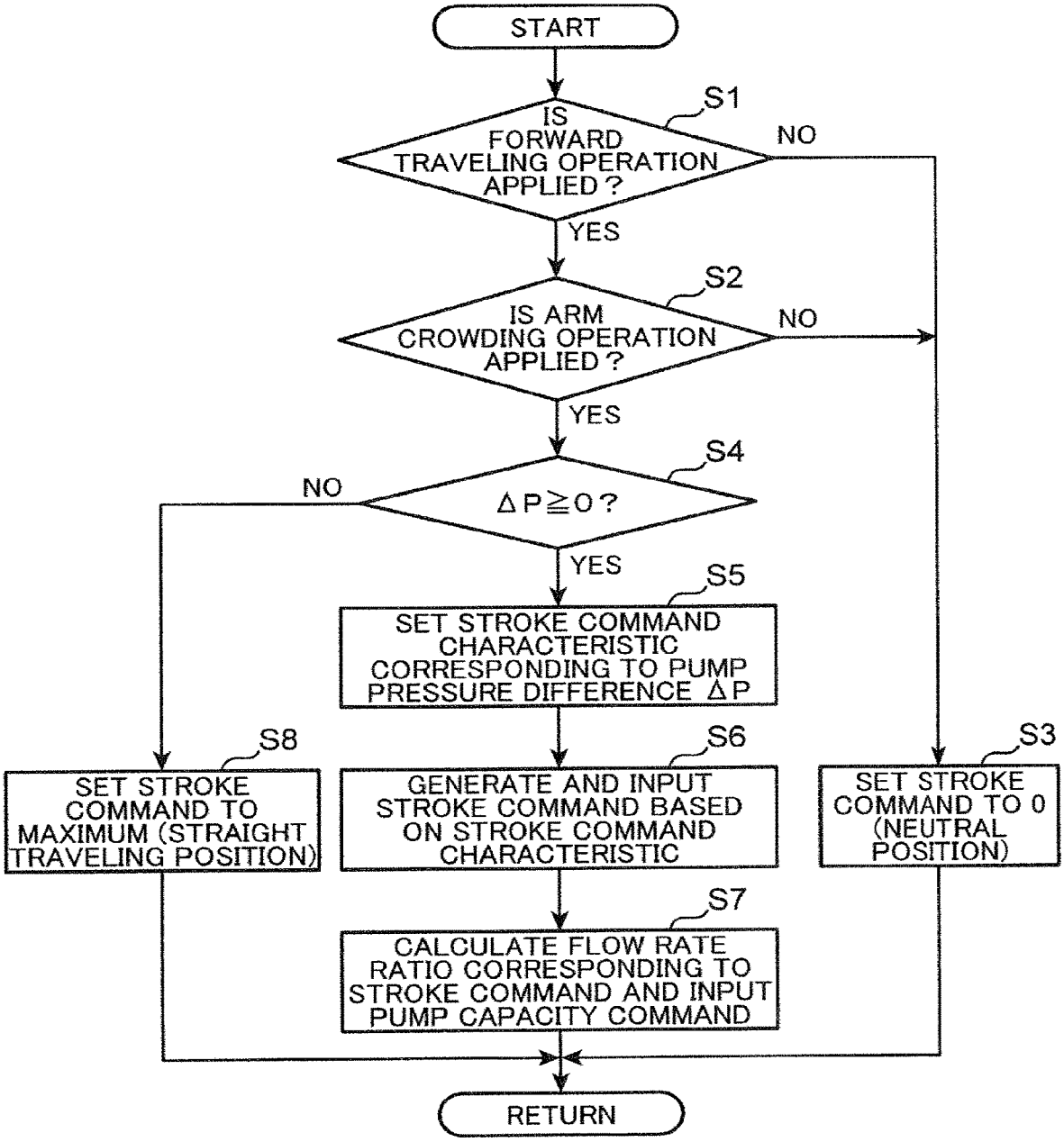
FIG. 5 is a flowchart showing a stroke control action for the traveling selector valve executed by the controller.

Although the flowchart of FIG. 5 teaches that the traveling selector valve 39 is held in the neutral position when the traveling operation and an operation for work other than the arm crowding operation (e.g., an arm pushing operation) are applied simultaneously, the stroke ST of the traveling selector valve 39 at this time is also not limited thereto. For example, the traveling selector valve 39 may be switched to the straight traveling position PS at this time.

Besides, the present invention encompasses, for example, the following modes.

(A) First and Second Traveling Motors

Although, in the above embodiment, the right traveling motor 25R corresponds to the first traveling motor while the left traveling motor 25L corresponds to the second traveling motor, it is also possible that, conversely, the left traveling motor 25L corresponds to the first traveling motor while the right traveling motor 25R corresponds to the second traveling motor.

(B) Communication Passage and Communication Throttle Portion

Although, in the circuit shown in FIG. 2, the communication passage 39*c* and the communication throttle portion 39*b* are incorporated in the traveling selector valve 39, the communication passage and the communication throttle portion according to the present invention may be disposed outside the traveling selector valve. For example, it is also possible to provide a communication passage for communication between the third supply line SL3 and the first center bypass line CL1 at a position immediately downstream of the traveling selector valve 39 shown in FIG. 2 and to dispose a flow control valve as the communication throttle portion in the communication passage. In other words, the switching control part according to the present invention may be one that simultaneously executes a switching control of the traveling selector valve and a control of the opening area of the flow control valve corresponding to the communication throttle portion provided thereoutside.

Meanwhile, the traveling selector valve incorporating a communication passage and a communication throttle portion involves an advantage of enabling the communication control to be executed through the operation of the stroke of the traveling selector valve for switching the position thereof, in addition to simplifying the apparatus. Besides, it enables the communication throttle portion to exert a function of reducing a torque shock causable by a sudden decrease in the flow rate in the first and second traveling motors when the traveling selector valve is shifted from the neutral position to the straight traveling position.

(C) Working Motion

The working motion performable by the working arm according to the present invention only has to include the traveling assist motion, that is, the motion of moving the machine body forward with the tip of the working arm stuck into the ground, thus not required to include any other motion. Besides, it is also possible that such a backward traveling assist motion as to move a machine body backward when the first or second traveling body is slipping while being driven backward is included and the communication control as described above is performed in such an assist motion.

(D) Communication Control

Although, in the above embodiment, the communication control is executed when the pump pressure difference ΔP is zero or more, the communication control may be executed only when the pump pressure difference ΔP is positive. In other words, the communication control does not have to be executed when the pump pressure difference ΔP is so small as to be substantially regarded as 0. Besides, the control is not limited which is to be executed at a time other than the time when a specific combined operation action of simultaneously making the forward traveling operation for moving the first and second traveling bodies forward and the specific working operation is performed. Specifically, in a state where the slip of the first and second traveling bodies and the accompanying traveling assist motion are not assumable, for example, in a state of simultaneous performance of the traveling operation and the arm pushing operation, it is also performable to switch the traveling selector valve to the straight traveling position while fully closing the communication passage.

(E) Stroke Command Characteristics

Although the stroke command characteristic setting part 52 according to the above embodiment determines the stroke command maximum value Xmax based on the pump pressure difference ΔP and sets the stroke characteristic based on the stroke command maximum value Xmax, the stroke command characteristic setting part 52 may be configured to store a plurality of stroke characteristics corresponding to the values of the plurality of pump pressure difference ΔP, respectively, and to select the most suitable one to the pump pressure difference ΔP from among the plurality of stroke characteristics. Alternatively, calculating a larger stroke correction value in response to the larger pump pressure difference ΔP and determining the value obtained by adding the stroke correction value to a reference stroke also enables such a control as to increase the stroke ST with an increase in the pump pressure difference ΔP to be executed.

(F) Pump Capacity Control

The present invention does not absolutely require a pump capacity control, which is therefore optional. Moreover, the first and second hydraulic pumps are not absolutely required to be a variable displacement type. For executing the pump capacity control, the flow rate ratio Rq of the first hydraulic pump only has to be set so as to increase with a decrease in the opening of the communication throttle portion as a result, not absolutely required to be set based on the stroke of the traveling selector valve (the stroke command maximum value Xmax in the above embodiment). The flow rate ratio Rq may be set, for example, based on the pump pressure difference ΔP.

As described above, there is provided a hydraulic drive apparatus for hydraulically moving a traveling working machine equipped with a pair of left and right traveling bodies and a working arm, being capable of performing a suitable supply of hydraulic fluid to the traveling body and the working arm when a slip occurs in the traveling body.

Provided is a hydraulic drive apparatus installed in a traveling type working machine, which includes a machine body and a working arm, the machine body including a first traveling body and a second traveling body that are arranged left and right and capable of performing respective traveling motions of traveling forward and backward on a traveling surface, the working arm being supported by the machine body and capable of performing a working motion including a traveling assist motion of moving the machine body forward while a tip of the working arm is stuck into the ground, to hydraulically cause the traveling motions of the first traveling body and the second traveling body and the working motion of the working device. The hydraulic drive apparatus includes: a plurality of working actuators that are supplied with hydraulic fluid to thereby actuate the working arm, the working actuators including a specific working actuator that makes the working arm perform the traveling assist motion; a first traveling motor that is supplied with hydraulic fluid to thereby actuate the first traveling body; a second traveling motor that is supplied with hydraulic fluid to thereby actuate the second traveling body; a first hydraulic pump and a second hydraulic pump that discharge hydraulic fluid to be supplied to a plurality of hydraulic actuators including the plurality of working actuators, the first traveling motor and the second traveling motor; a traveling selector valve selectively switchable to a neutral position and a straight traveling position as a position for forming a flow passage to lead hydraulic fluid discharged from the first hydraulic pump and the second hydraulic pump to the plurality of hydraulic actuators, the traveling selector valve forming, in the neutral position, a fluid passage that allows hydraulic fluid discharged from the first hydraulic pump to be supplied to the first traveling motor and allows hydraulic fluid discharged from the second hydraulic pump to be supplied to the second traveling motor and the specific working actuator and forming, in the straight traveling position, a working fluid passage that allows hydraulic fluid discharged from the first hydraulic pump to be supplied to the specific working actuator while preventing hydraulic fluid discharged from the first hydraulic pump from being supplied to the first traveling motor and the second traveling motor, and a traveling fluid passage that allows hydraulic fluid discharged from the second hydraulic pump to be supplied to the first traveling motor and the second traveling motor; a communication throttle portion provided in a communication passage providing communication between the working fluid passage and the traveling fluid passage so as to allow hydraulic fluid to flow from the working fluid passage to the traveling fluid passage, the communication throttle portion having an opening degree variable to increase and decrease a flow rate of the hydraulic fluid in the communication passage; a first pump pressure detector that detects a first pump pressure which is a pressure of hydraulic fluid that the first hydraulic pump discharges; a second pump pressure detector that detects a second pump pressure which is a pressure of hydraulic fluid that the second hydraulic pump discharges; and a switching control part configured to switch the traveling selector valve to the neutral position when a single operation action of making only one of a traveling operation for making the first traveling body and the second traveling body travel and a specific working operation for moving the specific working actuator is performed and configured to switch the traveling selector valve to the straight traveling position when a specific combined operation action of simultaneously making a forward traveling operation for making the lower traveling body travel forward and the specific working operation is performed. The switching control part is configured to perform a communication control of adjusting the opening degree of the communication throttle part so as to reduce the flow rate of the hydraulic fluid in the communication passage with an increase in a pump pressure difference, which is a difference between the first pump pressure and the second pump pressure, in the case where the pump pressure difference is positive when the specific combined operation action is performed.

The switching control part in this apparatus, adjusting the opening degree of the communication throttle portion so as to reduce the flow rate of the hydraulic fluid in the communication passage with an increase in the pump pressure difference in the case where the pump pressure difference, which is the difference between the first pump pressure and the second pump pressure, is positive, makes it possible to supply hydraulic fluid to the first and second traveling bodies and the working arm with a suitable distribution in a situation where a slip occurs in the first and second traveling bodies. Specifically, when the degree of slip is so large that the first and second traveling bodies are in idle state or near, where respective loads of the first and second traveling motors for moving the first and second traveling bodies, respectively, are extremely small, the switching control part greatly restricts the flow rate of the hydraulic fluid flowing from the working fluid passage to the traveling fluid passage in the communication passage to thereby prevent a large amount of hydraulic fluid discharged from the first hydraulic pump from flowing to the first and second traveling motors having a small load to disable hydraulic fluid from being sufficiently suppled to the specific working actuator, thereby enabling the specific working actuator to make the working arm perform the working assist motion. On the other hand, when the degree of the slip is small to allow the first and second traveling bodies to perform the traveling motions even with their slips and to allow the load of the first and second traveling motors to be relatively large, the switching control part relaxes the restriction on the flow rate of the hydraulic fluid in the communication passage, thereby making it possible to supply a part of the hydraulic fluid discharged from the second hydraulic pump to the first and second traveling motors to secure a traveling driving force.

Although the communication passage and the communication throttle portion may be provided outside the traveling selector valve, it is more preferable that the communication passage and the communication throttle portion are incorporated in the traveling selector valve. Specifically, the traveling selector valve, preferably, is configured to form the communication passage in the straight traveling position and incorporates the communication throttle portion so that the opening degree of the communication throttle portion is decreased to reduce the opening area of the communication throttle portion with an increase in a stroke of the traveling selector valve from the neutral position. This enables the communication control to be executed through the adjustment of the stroke of the traveling selector valve from the neutral position. Besides, the communication throttle portion is enabled to exert a function of reducing torque shocks of the first and second traveling motors causable by switching from the neutral position to the straight traveling position.

In this mode, the switching control part can be constituted by a stroke operation part that changes the stroke of the traveling selector valve according to input of a stroke command to the stroke operation part and a stroke control part that generates the stroke command and inputs the stroke command to the stroke operation part to control the stroke. Specifically, the stroke control part is preferably configured to input the stroke command for making the stroke zero to the stroke operation part when the single operation action is performed and configured to input the stroke command for increasing the stroke with an increase in a pump pressure difference, which is a difference between the first pump pressure and the second pump pressure, to the stroke operation part in the case where the pump pressure difference is positive when the specific combined operation is performed. The stroke control part can perform both the position switching control of the traveling selector valve and the communication control only by controlling the stroke of the traveling selector valve.

As a specific mode for switching the fluid passage by the traveling selector valve, it is preferable that: the second hydraulic pump is connected to the second traveling motor and the specific operation actuator while bypassing the traveling selector valve; the fluid passage that the traveling selector valve forms in the neutral position is a fluid passage that connects the first traveling motor to the first hydraulic pump while blocking the first traveling motor from the second hydraulic pump; the working fluid passage that the traveling selector valve forms in the straight traveling position is a fluid passage that connects the second hydraulic pump to the specific operation actuator while blocking the second hydraulic pump from the first traveling motor; and the traveling fluid passage that the traveling selector valve forms in the straight traveling position is a fluid passage that connects the first hydraulic pump to the first traveling motor.

The working arm preferably includes a boom having a proximal end portion connected to the machine body so as to be raiseable and lowerable and a distal end portion on an opposite side to the proximal end portion, an arm having a proximal end portion connected to the distal end portion of the boom so as to be movable rotationally about a horizontal axis and a distal end portion on an opposite side to the distal end portion, and a distal attachment that is attached to the distal end portion of the arm, the plurality of working actuators including a boom cylinder that raises and lowers the boom and an arm cylinder that rotationally moves the arm. The arm cylinder can serve as the specific working actuator that rotationally moves the arm in a crowding direction in which the arm approaches the boom while the tip attachment is stuck into the ground to thereby make the working arm perform the traveling assist motion.

In this mode, it is more preferable that the switching control part is configured to perform the communication control only when the forward traveling operation and an arm crowding operation for moving the arm in the crowding direction are simultaneously made, that is, only when the specific combined operation action is performed. This allows the communication control to be prevented from being performed when no slip occurs in either of the first and second traveling bodies or the degree of slip is so small that the traveling assist motion is not required.

In this case, it is more preferable that the switching control part is configured to decrease the opening degree of the communication throttle portion with an increase in the arm crowding operation and to decrease the opening degree of the communication throttle portion corresponding to the magnitude of the same arm crowding operation with an increase in the pump pressure difference. This allows to be achieved both the communication control based on the pump pressure difference and the control to increase the independence between the hydraulic fluid supplied to the working actuator and the hydraulic fluid supplied to the traveling device with an increase in the demand for the traveling assist motion with the large arm crowding operation.

In the case where each of the first hydraulic pump and the second hydraulic pump is a variable displacement hydraulic pump, it is preferable that the hydraulic drive apparatus further includes a capacity control part that increases and decreases the capacity of the first hydraulic pump and the capacity of the second hydraulic pump so as to increase a ratio of a first pump flow rate which is a flow rate of hydraulic fluid discharged by the first hydraulic pump to the sum of the first flow rate and a second pump flow rate which is a flow rate of hydraulic fluid discharged by the second hydraulic pump with a decrease in the opening degree of the communication throttle portion when the pump pressure difference is positive. The capacity control part, configured to increase the ratio of the first pump flow rate to decrease the ratio of the second pump flow rate with an increase in the throttle of the communication passage because the degree of the slips of the first and second traveling bodies are large and the need for supplying hydraulic fluid to the specific working actuator is greater than that to the first and second traveling motors, enables the pump operation to be efficiently performed.

The invention claimed is:

1. A hydraulic drive apparatus installed in a traveling type working machine, which includes a machine body and a working arm, the machine body including a first traveling body and a second traveling body that are arranged left and right, each being capable of performing a traveling motion of traveling on a traveling surface forward and backward, the working arm being supported by the machine body and capable of performing a working motion including a traveling assist motion of moving the machine body forward while a tip of the working arm is stuck into the ground, to hydraulically cause the traveling motions of the first traveling body and the second traveling body and the working motion of the working device, the hydraulic drive apparatus comprising:

a plurality of working actuators that are supplied with hydraulic fluid to thereby actuate the working arm, the working actuators including a specific working actuator that makes the working arm perform the traveling assist motion;

a first traveling motor that is supplied with hydraulic fluid to thereby actuate the first traveling body;

a second traveling motor that is supplied with hydraulic fluid to thereby actuate the second traveling body;

a first hydraulic pump and a second hydraulic pump that discharge hydraulic fluid to be supplied to a plurality of hydraulic actuators including the plurality of working actuators, the first traveling motor and the second traveling motor;

a traveling selector valve selectively switchable to a neutral position and a straight traveling position as a position for forming a flow passage to lead hydraulic fluid discharged from the first hydraulic pump and the second hydraulic pump to the plurality of hydraulic actuators, the traveling selector valve forming, in the neutral position, a fluid passage that allows hydraulic fluid discharged from the first hydraulic pump to be supplied to the first traveling motor and allows hydraulic fluid discharged from the second hydraulic pump to be supplied to the second traveling motor and the specific working actuator and forming, in the straight traveling position, a working fluid passage that allows hydraulic fluid discharged from the first hydraulic pump to be supplied to the specific working actuator while preventing hydraulic fluid discharged from the first hydraulic pump from being supplied to the first traveling motor and the second traveling motor, and a traveling fluid passage that allows hydraulic fluid discharged from the second hydraulic pump to be supplied to the first traveling motor and the second traveling motor;

a communication throttle portion provided in a communication passage providing communication between the working fluid passage and the traveling fluid passage so as to allow hydraulic fluid to flow from the working fluid passage to the traveling fluid passage, the communication throttle portion having an opening degree variable to increase and decrease a flow rate of the hydraulic fluid in the communication passage;

a first pump pressure detector that detects a first pump pressure which is a pressure of hydraulic fluid that the first hydraulic pump discharges;

a second pump pressure detector that detects a second pump pressure which is a pressure of hydraulic fluid that the second hydraulic pump discharges; and a switching control part configured to switch the traveling selector valve to the neutral position when a single operation action of making only one of a traveling operation for making the first traveling body and the second traveling body travel and a specific working operation for moving the specific working actuator is performed and configured to switch the traveling selector valve to the straight traveling position when a specific combined operation action of simultaneously making a forward traveling operation for making the lower traveling body travel forward and the specific working operation is performed, wherein the switching control part is configured to perform a communication control of adjusting the opening degree of the communication throttle part so as to reduce the flow rate of the hydraulic fluid in the communication passage with an increase in a pump pressure difference, which is a difference between the first pump pressure and the second pump pressure, in the case where the pump pressure difference is positive when the specific combined operation action is performed, wherein the working arm includes a boom having a proximal end portion connected to the machine body so as to be raiseable and lowerable and a distal end portion on an opposite side to the proximal end portion, an arm having a proximal end portion connected to the distal end portion of the boom so as to be movable rotationally about a horizontal axis and a distal end portion on an opposite side to the distal end portion, and a distal attachment that is attached to the distal end portion of the arm; the plurality of working actuators includes a boom cylinder that raises and lowers the boom and an arm cylinder that rotationally moves the arm; and the arm cylinder serves as the specific working actuator that rotationally moves the arm in a crowding direction in which the arm approaches the boom while the tip attachment is stuck into the ground to thereby make the working arm perform the traveling assist motion, wherein the switching control part is configured to perform the communication control only when the specific combined operation action is performed, and wherein the switching control part is configured to decrease the opening degree of the communication throttle portion with an increase in the arm crowding operation and to decrease the opening degree of the communication throttle portion corresponding to the magnitude of the same arm crowding operation with an increase in the pump pressure difference.

2. The hydraulic drive apparatus according to claim 1, wherein the traveling selector valve forms the communication passage in the straight traveling position and incorporates the communication throttle portion so that the opening degree of the communication throttle portion is decreased to reduce an opening area of the communication passage with an increase in a stroke of the traveling selector valve from the neutral position.

3. The hydraulic drive apparatus according to claim 2, wherein the switching control part is constituted by a stroke operation part that changes the stroke of the traveling selector valve according to input of a stroke command to the stroke operation part and a stroke control part that generates the stroke command and inputs the stroke command to the stroke operation part to control the stroke.

4. The hydraulic drive apparatus according to claim 3, wherein the stroke control part is configured to input the stroke command for making the stroke zero to the stroke operation part when the single operation action is performed and configured to input the stroke command for increasing the stroke with an increase in a pump pressure difference, which is a difference between the first pump pressure and the second pump pressure, to the stroke operation part in the case where the pump pressure difference is positive when the specific combined operation is performed.

5. The hydraulic drive apparatus according to claim 1, wherein: the second hydraulic pump is connected to the second traveling motor and the specific working actuator while bypassing the traveling selector valve; the fluid passage that the traveling selector valve forms in the neutral position is a fluid passage that connects the first traveling motor to the first hydraulic pump while blocking the first traveling motor from the second hydraulic pump; the working fluid passage that the traveling selector valve forms in the straight traveling position is a fluid passage that connects the second hydraulic pump to the specific working actuator while blocking the first hydraulic pump from the first traveling motor; and the traveling fluid passage that the traveling selector valve forms in the straight traveling position is a fluid passage that connects the second hydraulic pump to the first traveling motor.

6. The hydraulic drive apparatus according to claim 1, wherein each of the first hydraulic pump and the second hydraulic pump is a variable displacement hydraulic pump, the hydraulic drive apparatus further comprising a capacity control part that increases and decreases the capacity of the first hydraulic pump and the capacity of the second hydraulic pump so as to increase a ratio of a first pump flow rate which is a flow rate of hydraulic fluid discharged by the first hydraulic pump to the sum of the first flow rate and a second pump flow rate which is a flow rate of hydraulic fluid discharged by the second hydraulic pump with a decrease in the opening degree of the communication throttle portion when the pump pressure difference is positive.

* * * * *